US009803802B2

(12) United States Patent
Cantemir et al.

(10) Patent No.: US 9,803,802 B2
(45) Date of Patent: Oct. 31, 2017

(54) METHOD AND SYSTEM FOR COMPRESSING GAS USING A LIQUID

(71) Applicant: Ohio State Innovation Foundation, Columbus, OH (US)

(72) Inventors: Codrin-Gruie Cantemir, Columbus, OH (US); Fabio Chiara, Columbus, OH (US); Marcello Canova, Columbus, OH (US); James Durand, Columbus, OH (US)

(73) Assignee: Ohio State Innnovation Foundation, Columbus, OH (US)

( * ) Notice: Subject to any disclaimer, the term of this patent is extended or adjusted under 35 U.S.C. 154(b) by 453 days.

(21) Appl. No.: 14/402,858

(22) PCT Filed: May 22, 2013

(86) PCT No.: PCT/US2013/042273

§ 371 (c)(1),
(2) Date: Nov. 21, 2014

(87) PCT Pub. No.: WO2013/177309

PCT Pub. Date: Nov. 28, 2013

(65) Prior Publication Data

US 2015/0132150 A1 May 14, 2015

Related U.S. Application Data

(60) Provisional application No. 61/650,101, filed on May 22, 2012.

(51) Int. Cl.
*F17C 5/06* (2006.01)
*F04F 5/04* (2006.01)
(Continued)

(52) U.S. Cl.
CPC ..... *F17C 5/06* (2013.01); *F04B 25/005* (2013.01); *F04B 39/0011* (2013.01); *F04F 5/04* (2013.01);
(Continued)

(58) Field of Classification Search
CPC ..... F04B 25/005; F04B 39/0011; F04F 5/04; F04F 99/00; F17C 2227/0157; F17C 2227/0192; F17C 5/06
See application file for complete search history.

(56) References Cited

U.S. PATENT DOCUMENTS 451,460 A 5/1891 Craven
586,100 A 7/1897 Knight
(Continued)

FOREIGN PATENT DOCUMENTS

CN 201363546 Y 12/2009
CN 101815893 A 8/2010
(Continued)

OTHER PUBLICATIONS

International Search Report and Written Opinion of the International Searching Authority from related application No. PCT/US2013/042273, mailed Oct. 8, 2013.
(Continued)

*Primary Examiner* — Duane Smith
*Assistant Examiner* — Cabrena Holecek
(74) *Attorney, Agent, or Firm* — Meunier Carlin & Curfman LLC

(57) ABSTRACT

A method of compressing gas includes maintaining a volume of gas at a first pressure within a first chamber. Pressurized liquid is forced into the first chamber through a nozzle having a curved profile. Based on the Coanda effect, the liquid compresses the volume of gas to a second pressure greater than the first pressure. The liquid is separated from
(Continued)

the gas in a second chamber while maintaining the gas at the second pressure to provide compressed, dry gas.

20 Claims, 6 Drawing Sheets

(51) Int. Cl.
*F04B 25/00* (2006.01)
*F04B 39/00* (2006.01)
*F04F 99/00* (2009.01)

(52) U.S. Cl.
CPC ..... *F04F 99/00* (2013.01); *F17C 2227/0157* (2013.01); *F17C 2227/0192* (2013.01)

(56) References Cited

U.S. PATENT DOCUMENTS

| | | | | |
|---|---|---|---|---|
| 1,326,652 | A | 12/1919 | Ehrhart | |
| 1,509,660 | A | 9/1924 | McKerahan | |
| 2,061,938 | A | 11/1936 | Griswold | |
| 3,337,121 | A | 8/1967 | Coanda | |
| 4,585,039 | A | 4/1986 | Hamilton | |
| 5,085,809 | A | 2/1992 | Stirling | |
| 5,387,089 | A * | 2/1995 | Stogner | F04B 9/1174 417/339 |
| 6,120,253 | A | 9/2000 | Graves | |
| 6,331,195 | B1 | 12/2001 | Faust et al. | |
| 6,619,930 | B2 * | 9/2003 | Jansen | F04B 45/064 417/384 |
| 6,652,243 | B2 * | 11/2003 | Krasnov | F04F 1/06 417/101 |
| 6,901,973 | B1 | 6/2005 | Hall et al. | |
| 2005/0284155 | A1 | 12/2005 | Bhatt et al. | |
| 2007/0000016 | A1 | 1/2007 | Handa | |
| 2008/0209916 | A1 | 9/2008 | White | |
| 2008/0209918 | A1 | 9/2008 | White | |
| 2010/0139777 | A1 | 6/2010 | Whiteman | |
| 2011/0155278 | A1 | 6/2011 | Ding | |
| 2011/0277860 | A1 | 11/2011 | Mazumdar et al. | |
| 2011/0314800 | A1 | 12/2011 | Fong et al. | |
| 2013/0287598 | A1 | 10/2013 | Fourneron et al. | |

FOREIGN PATENT DOCUMENTS

| | | | |
|---|---|---|---|
| CN | 103334899 | A | 10/2013 |
| CN | 103370495 | A | 10/2013 |
| CN | 203257492 | U | 10/2013 |
| WO | 2009/035311 | A1 | 3/2009 |
| WO | 2009/056856 | | 5/2009 |
| WO | 2013/148707 | A1 | 10/2013 |

OTHER PUBLICATIONS

International Preliminary Report on Patentability from related application No. PCT/US2013/042273, mailed May 14, 2014.
U.S. Appl. No. 14/505,122, filed Oct. 2, 2014.
International Search Report and Written Opinion, dated Feb. 23, 2015, received in connection with International Application No. PCT/US2014/066632.
Extended European Search Report of the European Patent Office, Application No. 13793286.9, dated Mar. 8, 2016, 5 pages.
First Office Action and English translation, Chinese Application No. 201380026927.6, issued Aug. 4, 2015, 12 pages.
Restriction Requirement, U.S. Appl. No. 14/505,122, issued Nov. 17, 2016, 10 pages.
Non-Final Office Action, U.S. Appl. No. 14/505,122, issued Apr. 21, 2017, 52 pages.
Non-Final Office Action, Chinese Application No. 201480063703.7, dated Apr. 5, 2017, 7 pages.
Decision to Grant, Chinese Application No. 201380026927.6, issued Dec. 15, 2015, 6 pages.

* cited by examiner

METHOD AND SYSTEM FOR COMPRESSING GAS USING A LIQUID

CROSS-REFERENCE TO RELATED APPLICATION

This application claims the benefit of U.S. Provisional Patent Application No. 61/650,101, filed on May 22, 2012, entitled "SimpleFill, a Novel Way to Compress NG for Fast At-Home Refill," the disclosure of which is expressly incorporated herein by reference in its entirety.

BACKGROUND

Compressed gas is useful in a number of different applications. For example, compressed natural gas vehicles include a tank for storing compressed natural gas used for propulsion. The tank stores the gas at a high pressure for use by an engine of the vehicle. Currently, approaches used to compress gas from a low pressure source (e.g., a residential line) to a high pressure tank (e.g., a vehicle storage tank) include using direct mechanical compression. These direct mechanical compression approaches use a reciprocating piston movable within a cylinder to compress the gas. In use, these systems can be expensive as well as difficult to repair and/or maintain.

SUMMARY

One aspect of concepts presented herein includes a method of compressing gas. The method includes maintaining a volume of gas at a first pressure within a first chamber. Pressurized liquid is forced into the first chamber. The pressurized liquid compresses the volume of gas to a second pressure greater than the first pressure. The liquid is separated from the gas in a second chamber while maintaining the gas at the second pressure to provide compressed, dry gas.

Another aspect includes a system for compressing gas. The system includes a liquid tank storing a liquid therein and a compression chamber fluidly coupled to the liquid tank and configured to compress a volume of gas. A separation assembly is fluidly coupled to the compression chamber and configured to separate liquid from the volume of gas. A pump assembly is fluidly coupled to the liquid tank, the compression chamber and the separation assembly. The pump assembly, during operation, is configured to provide pressurized liquid from the liquid tank to the compression chamber to compress the volume of gas from a first pressure to a second pressure. The pump assembly further transfers the volume of gas at the second pressure to the separation assembly and injects the volume of gas at the second pressure to the separation assembly to separate liquid from the volume of gas to produce compressed, dry gas.

Another example method for compressing a gas using a liquid includes maintaining a first volume of gas in a low pressure chamber and maintaining a second volume of gas in a high pressure chamber. The high pressure chamber can be fluidly connected to the low pressure chamber. Additionally, each of the low pressure and high pressure chambers can include a Coanda nozzle. The Coanda nozzles can be configured to increase entrainment of gas in liquid during compression. The method can further include providing pressurized liquid into the low pressure chamber through the Coanda nozzle, where the pressurized liquid compresses the first volume of gas to a first pressure. In addition, the method can further include providing pressurized liquid into the high pressure chamber through the Coanda nozzle, where the pressurized liquid compresses the second volume of gas to a second pressure greater than the first pressure. The pressurized liquid can be simultaneously provided to the low pressure and high pressure chambers.

Optionally, the method can further include providing a first pump configured to supply pressurized liquid to the low pressure chamber and providing a second pump configured to supply pressurized liquid to the high pressure chamber. Additionally, the first and second pumps can optionally be arranged in series. Alternatively or additionally, the method can include driving the first and second pumps with a same motor.

Alternatively or additionally, the method can optionally further include operating a control valve that is arranged between the low pressure and high pressure chambers. The control valve can be configured to control flow of at least one of pressurized liquid and gas between the low pressure and high pressure chambers. For example, the high pressure chamber can be positioned at a higher height with respect to the low pressure chamber such that the pressurized liquid flows by the force of gravity between the high pressure and low pressure chambers when the control valve is in an open position.

Optionally, the method can further include providing pressurized liquid from a liquid tank fluidly connected to the low pressure and high pressure chambers. The liquid tank can store the liquid therein.

Optionally, the method can further include separating the liquid from the gas while maintaining the gas at approximately the second pressure in a separator assembly fluidly connected to the high pressure chamber.

Optionally, the process of compressing gas in at least one of the low pressure and high pressure chambers can be approximately isothermal.

Alternatively or additionally, the pressurized liquid can be at least one of water, gasoline, diesel and a mixture of water and monoethylene glycol.

Optionally, the method can further include providing pressurized liquid to at least one of the low pressure and high pressure chambers through the Coanda nozzle by forming at least one liquid jet, receiving the liquid jet on a curved surface and guiding the liquid jet along the curved surface to create an area of low pressure and high turbulence in the liquid jet.

Another system for compressing a gas using a liquid can include a low pressure chamber configured for compressing gas to a first pressure and a high pressure chamber configured for compressing gas to a second pressure greater than the first pressure. Each of the low pressure and high pressure chambers can include a Coanda nozzle. The Coanda nozzles can be configured to increase entrainment of gas in the liquid during compression. The system can also include a pump assembly having a first pump in fluid connection with the low pressure chamber and a second pump in fluid connection with the high pressure chamber. The first and second pumps can be configured to supply liquid to the low pressure and high pressure chambers, respectively, through the Coanda nozzle. By supplying liquid to the low pressure and high pressure chambers, gas in the chambers can be compressed to the first and second pressures, respectively. In addition, the second pump can be arranged in series with the first pump.

Optionally, the first and second pumps can be configured to supply liquid to the low pressure and high pressure chambers to simultaneously compress gas to the first and second pressures, respectively.

Alternatively or additionally, the pump assembly can include a motor configured to drive the first and second pumps.

The system can optionally further include a control valve arranged between the low pressure and high pressure chambers. The control valve can configured to control flow of at least one of liquid and gas between the low pressure and high pressure chambers.

Optionally, the high pressure chamber can be positioned at a higher height with respect to the low pressure chamber such that the liquid flows by the force of gravity between the high pressure and low pressure chambers when the control valve is in an open position.

Alternatively or additionally, the system can optionally include a liquid tank fluidly connected to the low pressure and high pressure chambers and the pump assembly. The liquid tank can store the liquid therein.

Optionally, the system can include a separator assembly fluidly connected to the high pressure chamber. The separator assembly can be configured to separate the liquid from the gas while maintaining the gas at approximately the second pressure.

Optionally, the process of compressing gas in at least one of the low pressure and high pressure chambers can be approximately isothermal.

Alternatively or additionally, the liquid can be at least one of water, gasoline, diesel and a mixture of water and monoethylene glycol.

Optionally, each of the Coanda nozzles can include a jet plate having at least one slot for forming a liquid jet and a curved entry portion in fluid connection with the jet plate. The curved entry portion can receive the liquid jet. The curved entry portion can also be configured to create an area of low pressure and high turbulence in the liquid jet as the liquid jet flows along the curved entry portion.

DETAILED DESCRIPTION

Figure 1:
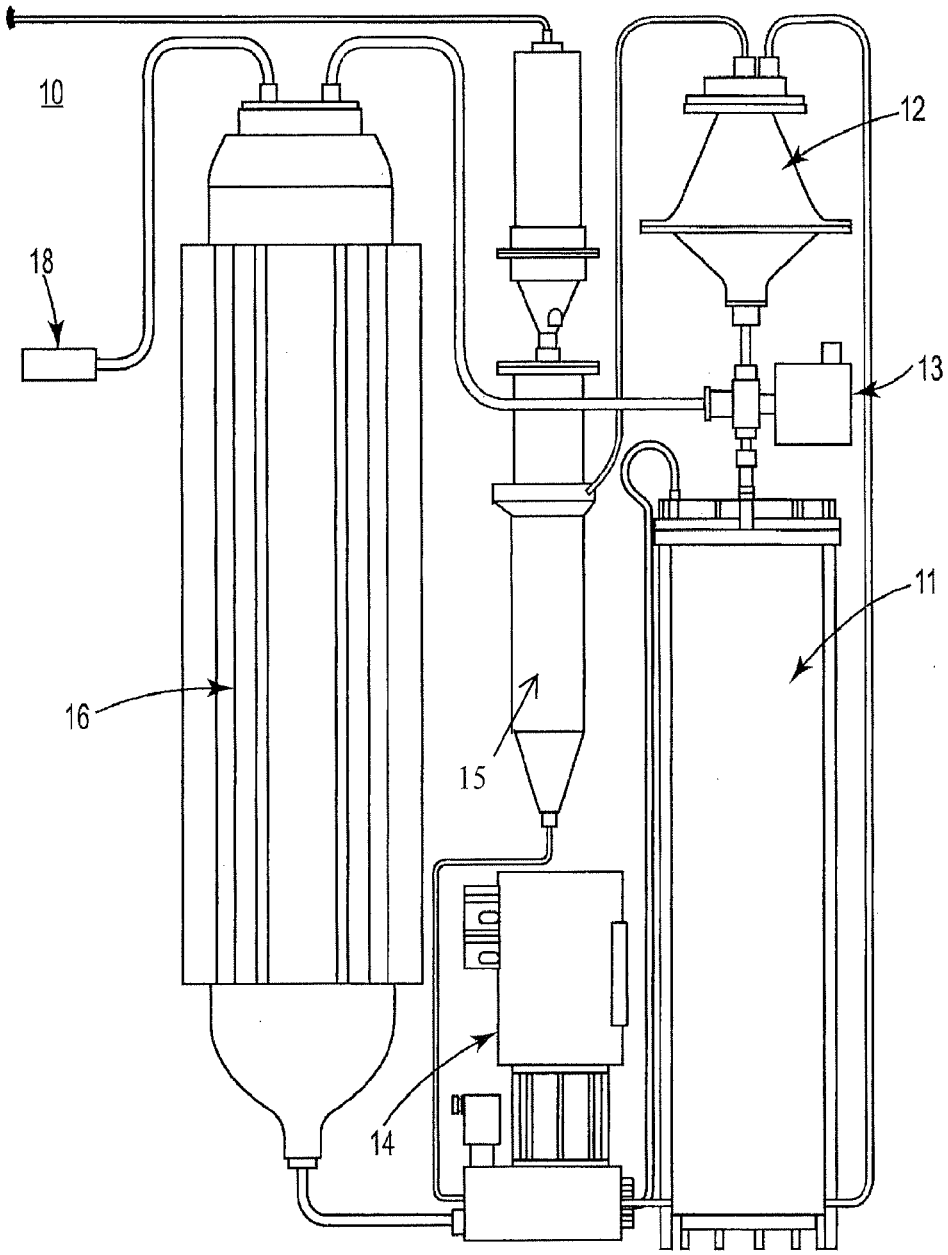
FIG. 1 is a schematic view of a system for compressing gas using a liquid.

FIG. 1 is a schematic view of a system 10 capable of implementing a process using a pressurized liquid (e.g., water, gasoline, diesel fuel) to compress a gas (e.g., natural gas, hydrogen, inert gases). Optionally, this disclosure contemplates that the pressurized liquid can be a mixture of fluids such as water and monoethylene glycol (MEG), for example. Fluid mixtures can be used to ensure operations at extreme temperatures. It will be appreciated that system 10 can include components such as valves and the like to facilitate transfer of fluid within the system. As illustrated, the system 10 includes a first, low pressure (LP) compression chamber 11, a second, high pressure (HP) compression chamber 12, a transfer valve 13, a pump assembly 14, a separation assembly 15 and a liquid tank 16. Details of these components in system 10 are provided below. In general, however, the system 10 utilizes two stages of liquid compression (a first stage within the LP chamber 11 and a second stage within the HP chamber 12) coupled with a technique for cooling the gas during compression. During compression, a liquid piston is formed within a respective chamber and operates to compress gas within the chamber as well as provide a suitable medium for heat transfer from the compressed gas. In an alternative embodiment, system 10 can include only a single compression chamber. The single compression chamber in this embodiment would operate in a similar manner to the chambers 11 and 12 discussed herein.

In one example method for compression, gas enters the system 10 from a source 18 (e.g., a residential natural gas line) at a low pressure (e.g., not greater than 25 bar, approximately 0.5 bar or less). In a first stage of compression, the gas is compressed to a higher, intermediate pressure (e.g., approximately 20-22 bar) in the LP chamber 11 by liquid provided from the tank 16 using pump assembly 14. In one embodiment, the LP chamber 11 can have a fixed internal volume (e.g., about 20 liters). Subsequently, in a second stage of compression, the gas is compressed to yet a higher, storage pressure (e.g., at least 200 bar, approximately 400 bar) in the HP chamber 12 also by liquid provided from the tank 16 using the pump assembly 14. In one embodiment, the HP chamber 12 also has a fixed internal volume (e.g., about 2 liters).

Once the gas is compressed in the LP chamber 11 to the intermediate pressure, transfer valve 13 is used to transfer gas to the HP chamber 12. Pump assembly 14, in one embodiment, includes at least two pumps used to introduce the liquid to chambers 11 and 12 such that the gas is compressed to a desired exiting gas pressure. In one example, the pump assembly 14 includes a first pump designed to achieve high flow/low pressure of fluid within system 10 and a second pump designed to achieve high pressure/low flow of fluid within system 10. Regardless of configuration of pump assembly 14, gas exiting HP chamber 12 is then filtered to remove water or other impurities in the separation assembly 15 prior to being delivered to a storage tank (e.g., located on a vehicle).

The liquid used for compression is continuously recirculated and stored in the tank 16. In one embodiment, the liquid is pressurized with compressed gas from the compressed gas source 18. In one embodiment, the source 18 includes one or more valves to control entry of gas into the tank 16. Transfer valve 13 can control entry of gas from the tank 16 to chamber 11 as well as entry of gas from LP chamber 11 to HP chamber 12. Pump assembly 14 is configured to provide liquid from tank 16 to LP chamber 11, HP chamber 12 and receive liquid from the separation assembly 15. If desired, the tank 16 can include one or more cooling features (e.g., external cooling fins) to dissipate residual heat in the liquid.

Optionally, transfer valve 13 can be a three-way valve. It should be understood that transfer valve 13 can be electrically controlled (e.g., repositioned by sending a control signal to transfer valve 13). For example, transfer valve 13 can control entry of gas from the gas source 18 into the LP chamber 11 when in a first position, transfer valve 13 can control entry of gas from the gas source 18 into the HP chamber 12 when in a second position and transfer valve 13 can control flow of gas between the LP chamber 11 and the HP chamber 12 when in a third position. For instance, in the first position, transfer valve 13 controls the flow of gas from the gas source 18 into the LP chamber 11. As discussed above, the gas can then be compressed to an intermediate pressure in the LP chamber 11 by introducing liquid into the LP chamber 11. When the gas is compressed to the intermediate pressure, transfer valve 13 can be repositioned to the third position in order to control the flow of gas between the LP chamber 11 and the HP chamber 12. Optionally, while the gas flows from the LP chamber 11 to the HP chamber 12, the liquid can continue to be introduced, and in some implementations, liquid can flow from the LP chamber 11 to the HP chamber 12. The liquid that enters the HP chamber 12 can prevent the gas from flowing backward from the HP chamber 12 to the LP chamber 11. Then, when a small amount of liquid is introduced into the HP chamber 12 from the LP chamber 11, transfer valve 13 can be repositioned to the second position to control the entry of gas from the gas source 18 into the HP chamber 12. As discussed above, the gas can then be compressed to a storage pressure in the HP chamber 12 by introducing liquid into the HP chamber 12.

The LP chamber 11 and HP chamber 12 operate identical in principle and, for sake of brevity, only the LP chamber 11 is discussed in detail below. Principles explained with respect to LP chamber 11 are applicable to the structure and operation of HP chamber 12. As discussed in more detail below, each of the chambers include a liquid piston operable to compress gas utilizing a Coanda nozzle having a curved profile that operates to inject a liquid into a respective chamber. In general, a volume of gas is introduced into the chamber. Liquid is subsequently injected into the chamber through the nozzle and, according to the Coanda effect, entrains the gas as the liquid flows along the nozzle. As liquid level rises in the chamber a liquid piston is formed. In addition, the Coanda nozzle and compression chamber are designed to enhance the circulation of the gas while the gas is being compressed within the chamber. Due to the liquid within the chamber, the liquid can cool the gas as it is compressed at a high rate of heat transfer and approaching isothermal compression (i.e., a minimal change of temperature within the chamber during gas compression).

Figure 2:
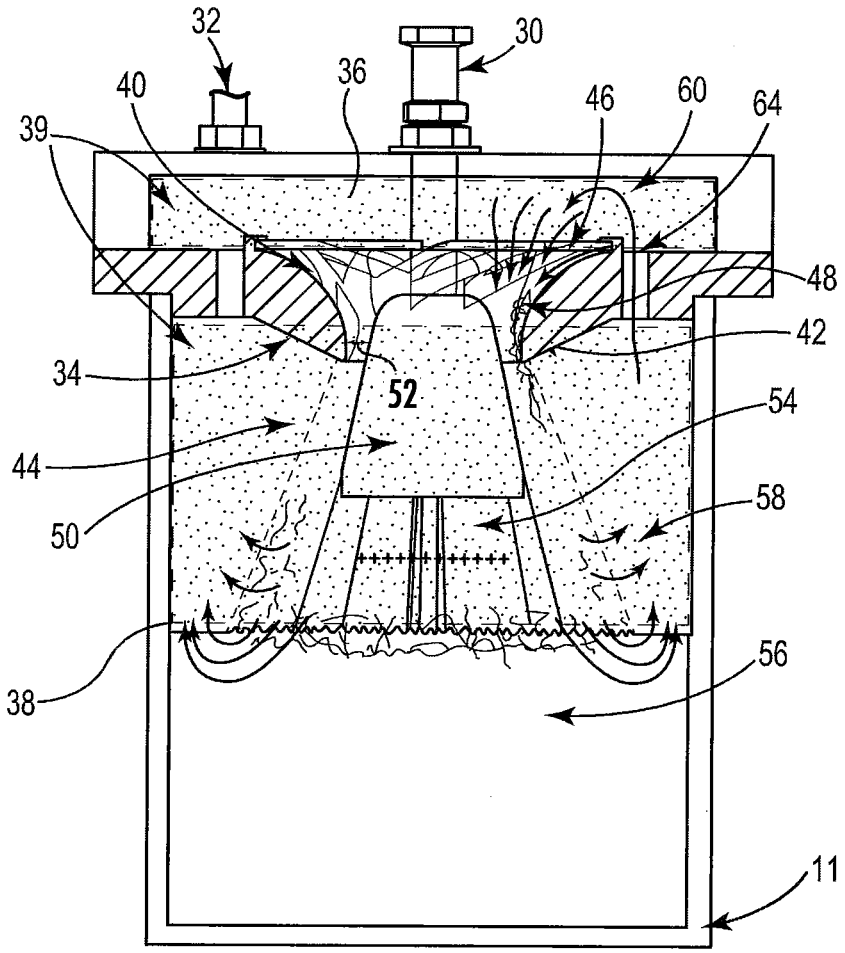
FIG. 2 is a schematic sectional view of a compression chamber used in the system of FIG. 1.

FIG. 2 shows a cross section of the LP chamber 11 where gas introduced into the chamber 11 via a gas inlet 30 is compressed using a liquid introduced through a liquid inlet 32. Inlet 32 is fluidly coupled to a nozzle 34 that divides the chamber 11 between an upper portion 36 and a lower portion 38. A volume of gas 39 is positioned in the upper portion 36 and lower portion 38 for compression. Nozzle 34 operates according to the Coanda effect to entrain gas 39 in the chamber due to introduction of liquid into the nozzle 34. In particular, due to the Coanda effect, as the liquid flows at a high rate over a curved surface (i.e., nozzle 34), a high flow of the gas (i.e., gas 39 from upper portion 36) surrounding the nozzle 34 will also be entrained. It should be understood that for Coanda applications, the ratio between the primary fluid (e.g., the liquid) and secondary fluid (e.g., the gas) volumetric flows is significantly higher than can be achieved with ejectors, for instance, the ratio can be between approximately 10 and 80. The nozzle 34 also acts as a transfer pump using the liquid to entrain the gas and circulate a liquid-gas mixture through the chamber 11. As the liquid level rises, the gas in the chamber 11 is compressed.

Figure 3:
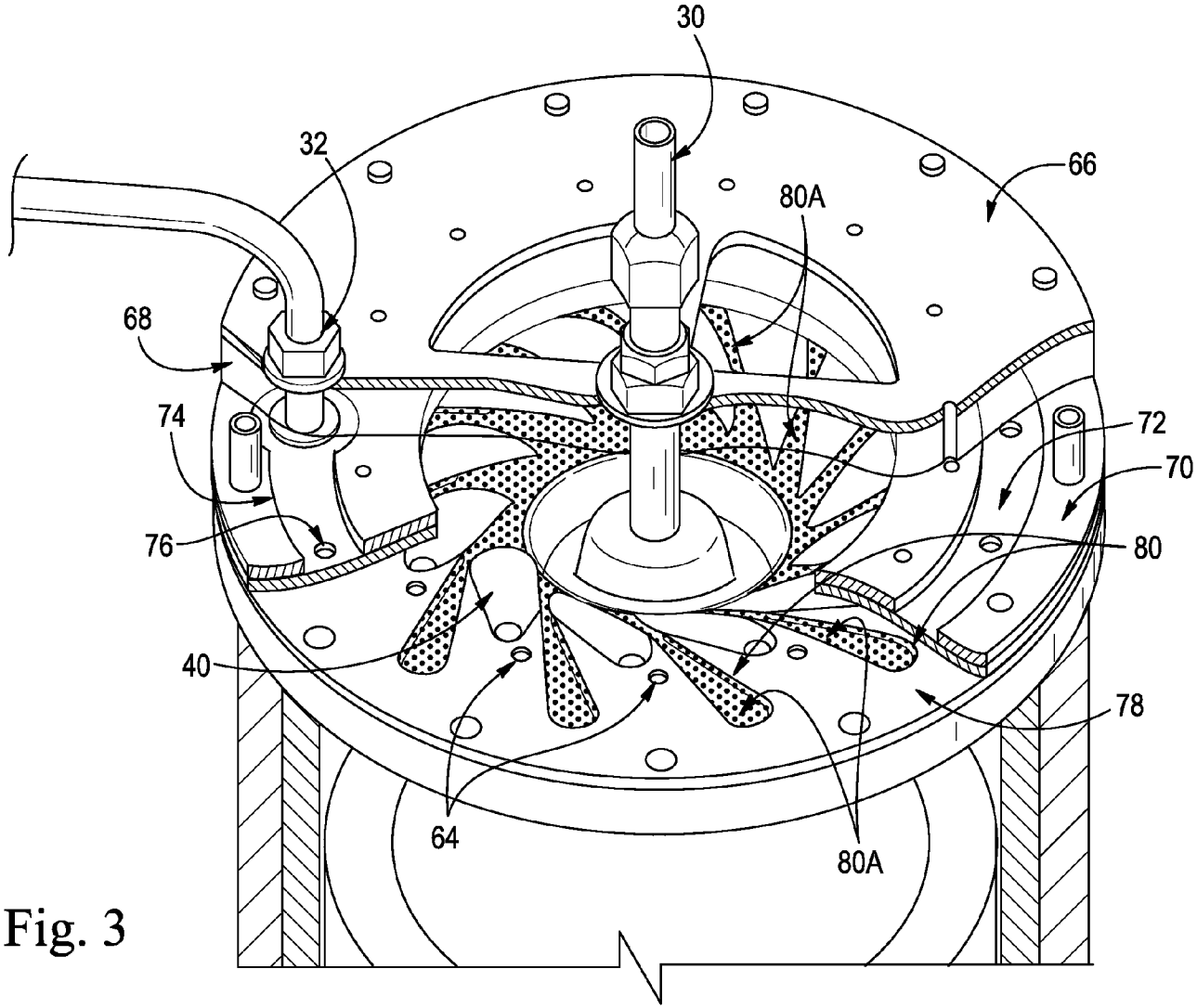
FIG. 3 is a schematic, partial sectional view of a nozzle for delivering liquid to the compression chamber illustrated in FIG. 2.

The nozzle 34 can take many forms. In the embodiment illustrated, the nozzle 34 converges along an entry portion 40 to a throat portion 42. In one embodiment, the liquid is injected into the nozzle 34 with high velocity (e.g., at least 10 m/s) from inlet 32 using pump assembly 14 and exits at throat portion 42 to form a liquid cone 44 extending from the nozzle 34. Liquid introduced to the nozzle 34 flows along the entry portion 40 as indicated by an arrow 46 in a cyclonic manner. Once exiting throat portion 42, the liquid continues to flow in the cyclonic manner to form the liquid cone 44. In the embodiment illustrated, the entry portion 40 is axisymmetric around a longitudinal axis of the nozzle 34. In one embodiment, the curved entry portion 40 can define a parabolic profile that includes one or more structural features (e.g., slots) to create desired turbulence in flow of liquid along the entry portion 40. Alternatively or additionally, as shown in FIG. 3, the curved entry portion 40 can define a parabolic profile having a smooth surface. Alternatively or additionally, the parabolic profile can include one or more structural features such as steps (e.g., bumps, raised portions, etc.) to create turbulence in the flow of liquid along the curved entry portion 40. During the flow of liquid, the Coanda effect will keep liquid jets, which are discussed in detail below, attached to the curved entry portion 40 so as to create an area 48 of low pressure and high turbulence over the entry portion 40. Due to the low pressure and high turbulence created in area 48, gas entrainment in the liquid jets is maximized from the upper portion 36, bringing the gas to the lower portion 38. Alternatively or additionally, one or more of the liquid jets can define a curved wall jet. Due to the destabilizing effect of the curvature on the turbulence in the outer part of the liquid jet, it is possible to increase the amount of gas entrainment in the liquid jet. This can increase the amount of mixing between the gas and the liquid, and therefore, can also increase the amount of heat transfer.

The nozzle 34 further includes a bell-shaped portion 50 disposed within the chamber along a longitudinal axis of the nozzle 34 in relation to throat portion 42. By changing a vertical position of the portion 50, a minimum cross section 52 of the throat portion 42 can be varied. In principle, a larger minimum cross section 52 will allow for a higher gas flow from the entry portion 40 to the cone 44. However, a smaller minimum cross section 52 will cause a direct increase in gas speed and enhance a turbulence level of a mixture of gas and liquid within chamber 11. Based on experimentation, a desired maximum heat transfer can be determined by adjusting flow, speed and turbulence of fluid within the chamber 11.

After liquid passes through the throat portion 42, the liquid forms the cone 44 with assistance from the bell-shaped profile 50. In one embodiment, an angle defined by the entry portion 40 and cone 44 is greater than 90 degrees. Additionally, or independently, a swirl component can be introduced in the entry portion 40 to create a cyclonic flow about the nozzle 34. In relation to the bell-shaped portion 50, the cone 44 can define a greater angle with respect to the entry portion 40 than a corresponding angle between the bell-shaped portion 50 and the entry portion 40. In this configuration, flow between the bell-shaped portion 50 and the cone 44 will have a diffuser effect with a slight increase of gas pressure at the end of the bell-shaped portion 50 at a zone 54 in relation to an average gas pressure within the chamber 11. This diffusing process can also increase turbulence within chamber 11. As a result of this configuration, gas will tend to escape at a bottom of the cone 44, either by passing through the cone 44 and/or through a liquid piston 56 formed in the chamber 11. As more liquid enters chamber 11, liquid piston 56 increases in volume to compress gas within the chamber 11.

Ultimately, gas escapes from the cone 44 as depicted by arrows 58. Once exited from the cone 44, gas is drawn to the upper portion 36 following arrow 60 via recirculation channels 64 positioned about the nozzle 34. In one embodiment, due to the configuration of the nozzle 34, gas within chamber 11 will circulate at least twenty times for each compression cycle. For the HP chamber 12, a small low head recirculation pump can be used to achieve a higher number of recirculation cycles to counteract reduced heat exchange surface of the HP chamber 12.

FIG. 3 illustrates a partial sectional view of the nozzle 34. In one embodiment, as illustrated, the entry portion 40 is formed of a single unitary body. One embodiment includes the flow profile 40 having a geometry described (in a simplified form) by a parabola with an inclined axis of approximately 30-45 degrees and a D/a ratio of 2.5 to 4. In one embodiment, the entry portion 40 can be formed as described in U.S. Pat. No. 3,337,121.

From inlet 32, liquid flow is provided through a retaining plate 66 and cover plate 68. In an alternative embodiment, plates 66 and 68 can be formed of a single plate. The liquid is then provided to a delivery manifold formed by a first plate 70 and a second plate 72. The first plate 70 defines a central channel 74 for flow of liquid to apertures 76 provided in the second plate 72. Liquid provided through the apertures 76 is provided to a jet plate 78 fluidly coupled to the entry portion 40. The jet plate 78 defines a plurality of slots 80. Optionally, the apertures 76 provided in the second plate 72 can be aligned with the slots 80 in the jet plate 78. Upon entry of liquid into the slots 80, liquid jets (e.g., liquid jet 80A in FIG. 3) are formed and provided to the entry portion 40. Additionally, each of the slots 80 can define a nozzle such that the velocity of the liquid jets increase as they move through a converging portion of the nozzles prior to being provided to the entry portion 40. This disclosure contemplates that the slots 80 can be formed by laser cutting the jet plate 78, for example. This disclosure contemplates that the number and spacing between the slots 80 can vary to achieve the desired effect, e.g., the desired amount of entrainment of the gas and the liquid and heat transfer between the gas and the liquid. Additionally, the slots 80 are formed proximate the recirculation channels 64 to enhance liquid and gas mixing. Optionally, the slots 80 and the recirculation channels 64 can be interleaved.

In the illustrated embodiment, the slots 80 are oriented at a 30 degree angle (relative to a tangent line of an outer circumference of the chamber 11) in order to produce a clockwise swirling motion of liquid entering the slots 80. This disclosure contemplates that that the slots can be oriented at angles other than 30 degree angle to produce the swirling motion. Alternatively or additionally, the slots 80 are not oriented approximately along a radius of the chamber 11 (e.g., a line extending from the center to the circumference of the chamber 11). Although different configurations can be utilized, each of the slots 80 in the illustrated embodiment converge from an entry point and each of the liquid jets formed by liquid flowing through the slots 80 then diverges to a general confluence of each of the liquid jets upon entering entry portion 40. Variations of the jet plate 78 can include parametric variations of the swirl angle for slots 80, a confluence distance for each slot 80, plate thickness, exit area for slot 80 and exit angle of slot 80. In one embodiment, the jet plate 78 can be made of a suitable metal alloy such as 6061 aluminum or stainless steel.

Figure 4:
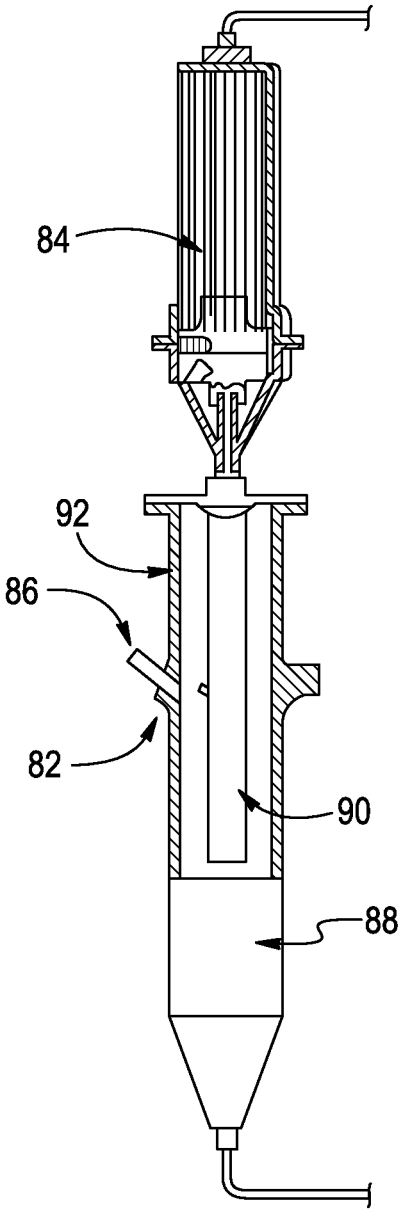
FIG. 4 is a schematic, view of a separation assembly used in the system of FIG. 1.

FIG. 4 schematically illustrates the separation assembly 15, which receives high pressure compressed gas from HP chamber 12. The compressed gas is mixed with water in a liquid/gas mixture due to the compression taken place within the LP chamber 11 and the HP chamber 12. The separation assembly 15 includes a cyclonic separator 82 forming a chamber and optionally a rotor blade 84 that is utilized to separate gas from the liquid and produce compressed, dry gas. The compressed gas from HP chamber 12 is first delivered to an inlet 86 of the cyclonic separator 82 from operation of pump assembly 14. The cyclonic separator 82 illustratively includes an outer tube 88 and an inner tube 90 positioned within the outer tube 88. In one embodiment, both the outer tube 88 and inner tube 90 are metallic (e.g., cast iron, stainless steel). Gas is introduced to the outer tube 88 through the inlet 86 at a slight downward angle and tangential to an inner wall 92 of the outer tube 88 in order to produce a swirl. Centrifugal forces within the swirl operate to separate liquid from the gas. In particular, the liquid is forced against the inner wall 92 and travels along the wall 92 toward a bottom of the separator 82. After the swirl rotation diminishes, gas is transferred by the inner tube 90 to the rotor blade 84. In particular, gas turns 180 degrees into the inner tube 90 as the liquid, due to its high inertia, has the tendency to collect at the bottom of the outer tube 88.

Figure 5:
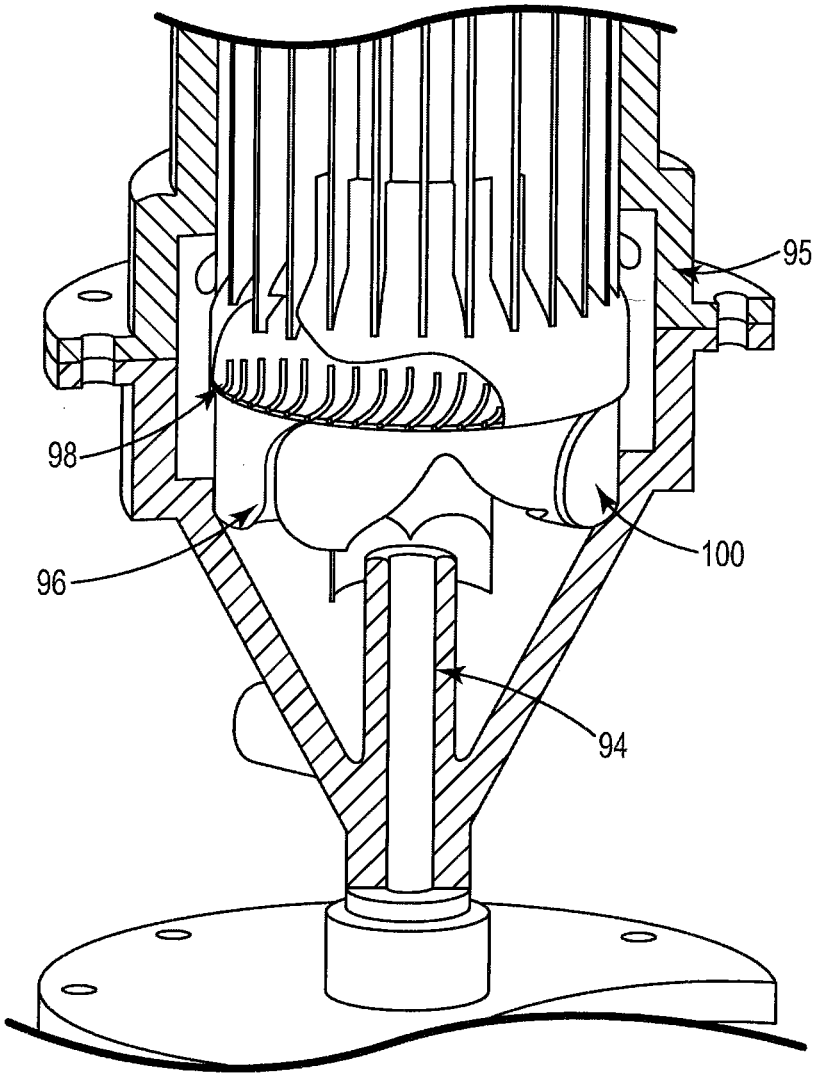
FIG. 5 is a schematic sectional view of a portion of the separation assembly of FIG. 4.

FIG. 5 illustrates a portion of the rotor blade 84 that receives compressed gas from the inner tube 90 through an inlet 94. In one embodiment, the rotor blade 84 is formed from a plastic material and positioned within a housing 95. The rotor blade 84 can be supported by lubrication free, high chemical resistance rolling bearings. The rotor blade 84 is driven by energy from flow of the gas from inner tube 90. After passing through inlet 94, the gas is accelerated using at least one nozzle 96 (two of which are illustrated) at a high speed (e.g., a speed of approximately 50 mls) and delivered at a shallow angle to a turbine 98 that includes a plurality of circumferentially spaced curved blades. The turbine 98 is a built as part of the rotor blade 84 and is located at the bottom of the rotor blade 84. The nozzles 96 are carved in a bearing carrier 100 positioned to receive flow from the inlet 94. It will be appreciated that different configurations for the nozzles 96 (e.g., number of nozzles, entry and exit angles for the nozzles) can be utilized.

Figure 6:
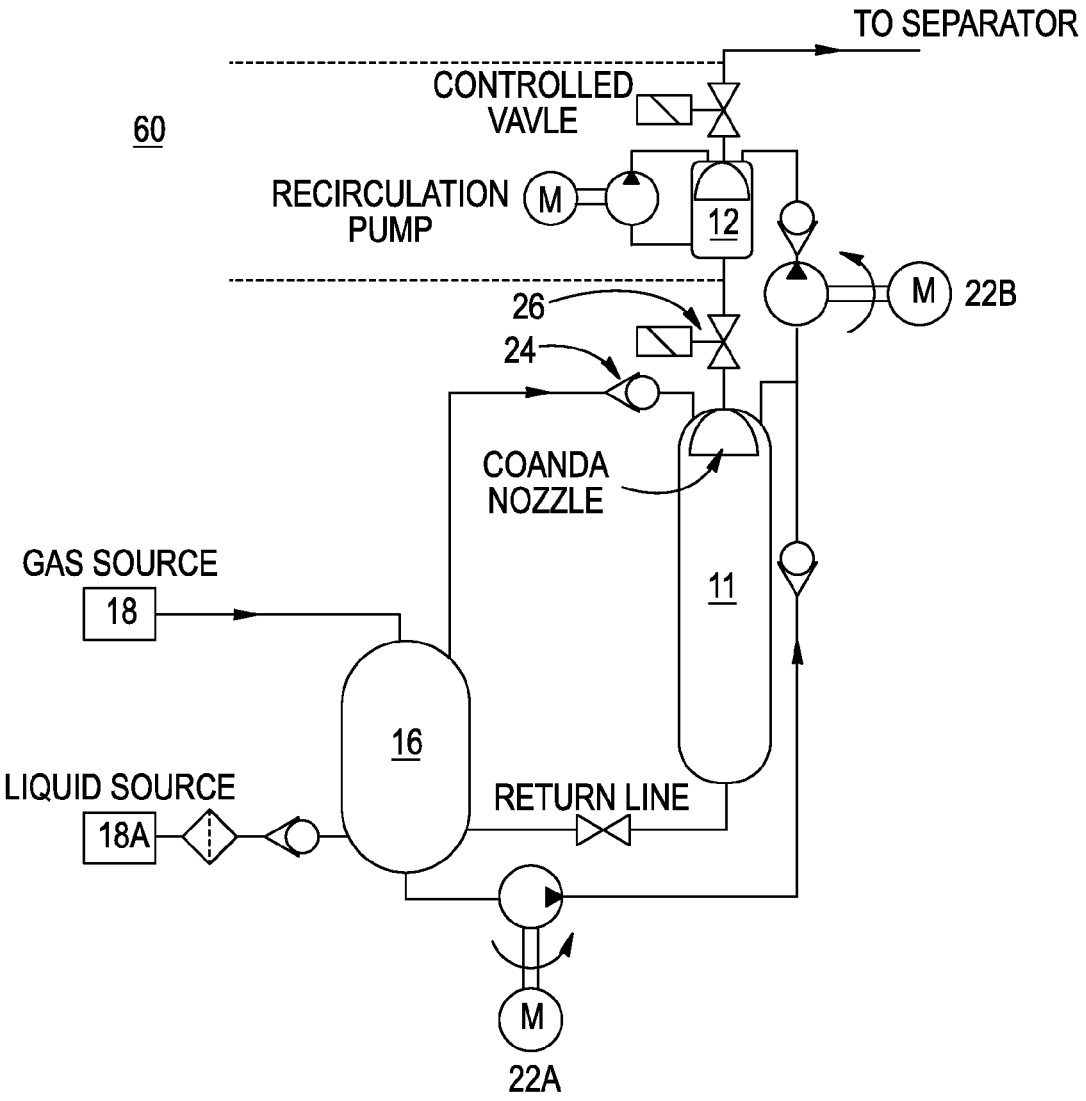
FIG. 6 is a schematic view of another system for compressing gas using a liquid.

FIG. 6 is a schematic view of another system 60 for implementing a process using pressurized liquid to compress a gas. The system 60 includes a LP chamber 11, a HP chamber 12 and a liquid tank 16. These system components are discussed in detail above with regard to FIG. 1 and are therefore not discussed in further detail below. It should be understood that the system 60 can include components such as valves, piping and the like to facilitate transfer of fluids (e.g., pressurized liquid and/or gas) within the system 60. Similar to FIG. 1, gas can be supplied to the system 60 from a gas source 18. A check valve or one-way valve 24 can be provided along the gas supply line to prevent gas from returning to the tank 16 when the compression process begins. Additionally, liquid can be supplied to the tank 16 from a liquid source 18A.

Also similar to FIG. 1, in FIG. 6, the gas can be compressed to a higher, intermediate pressure in the LP chamber 11 by liquid provided from the tank 16 during a first stage of compression. Subsequently, in a second stage of compression, the gas can be compressed to yet a higher, storage pressure in the HP chamber 12 by liquid provided from the tank 16. Additionally, as discussed above with regard to FIG. 1, after the second stage of compression, the gas can flow to a separator assembly fluidly connected to the HP chamber 12, where liquid can be removed from the gas such that dry, compressed gas remains. In FIG. 6, the pump assembly can include a plurality of pumps, for example, two pumps 22A-22B. Pumps 22A-22B can be used to supply water to the LP chamber 11 and the HP chamber 12. In other words, pumps 22A-22B can be used to power the liquid pistons.

Specifically, pump 22A can be used to supply liquid to the LP chamber 11, and pump 22B can be used to supply liquid to the HP chamber 12.

Optionally, pump 22A can be a high flow, low pressure pump, which is appropriate for the flow requirements of the LP chamber 11. For example, pump 22A can be a multi-stage centrifugal pump. Alternatively or additionally, pump 22B can be a low flow, high pressure pump, which is appropriate for the flow requirements for the HP chamber 12. For example, pump 22B can be a radial piston pump. In addition, pumps 22A-22B can optionally be fluidly connected in series. As shown in FIG. 6, pump 22A can provide liquid to both the LP chamber 11 and pump 22B. In this configuration, pump 22A can provide suction head for pump 22B. Additionally, according to this configuration, when pumps 22A-22B are operated in series, the LP chamber 11 and HP chamber 12 can be supplied with liquid (and compression can be performed) at the same time, e.g., simultaneously, in the LP and HP chambers. For example, to compress gas in the LP chamber 11, liquid can be pumped from the tank 16 to the top of the LP chamber 11, where the liquid is injected through the Coanda nozzle, which results in entrainment of gas and heat transfer between the liquid and gas. At the same time, liquid can be pumped from the tank 16 to the top of the HP chamber 12, where the liquid is injected through the Coanda nozzle, which results in entrainment of gas and heat transfer between the liquid and gas. The compression processes are therefore performed in batch, with the two liquid pistons operating simultaneously. Additionally, pumps 22A-22B and their arrangement in the system 60 can be selected to minimize energy consumption.

Alternatively or additionally, a control valve 26 can be provided between the LP chamber 11 and the HP chamber 12. The control valve 26 can control flow of fluid (e.g., gas and/or liquid) between the LP and HP chambers. Optionally, the HP chamber 12 can be arranged or positioned above (e.g., at a higher height with respect to) the LP chamber 11. In this configuration, when the control valve 26 is in an open position (e.g., allowing fluid to flow between the LP and HP chambers), the compressed gas in the LP chamber 11 can be transferred into HP chamber 12. Additionally, as shown in FIG. 6, the liquid return from the HP chamber 12 (e.g., the liquid used for compressing gas during the previous cycle) is through the LP chamber 11. Thus, by the force of gravity, the liquid can also be transferred from the HP chamber 12 to the LP chamber 11 through the control valve 26. As discussed above, the liquid can then ultimately be returned to the tank 16, where the liquid can optionally be cooled by convection, for example, before being re-used for injection into the LP and HP chambers during a subsequent compression cycle. In this configuration, a single control valve (e.g., control valve 26) can be used to transfer both the gas and liquid between the LP and HP chambers. Accordingly, it is possible to reduce the scavenging work that would otherwise be necessary to expel the compressed gas from the HP chamber 12.

Although the present disclosure has been described with reference to preferred embodiments, workers skilled in the art will recognize that changes can be made in form and detail without departing from the spirit and scope of the present disclosure.

What is claimed is:

1. A method for compressing a gas using a liquid, comprising:

maintaining a first volume of gas in a first chamber, the first chamber comprising a first Coanda nozzle;

maintaining a second volume of gas in a second chamber, the second chamber being fluidly connected to the first chamber and comprising a second Coanda nozzle;

providing pressurized liquid into the first chamber through the first Coanda nozzle, wherein the pressurized liquid compresses the first volume of gas to a first pressure; and providing pressurized liquid into the second chamber through the second Coanda nozzle, wherein the pressurized liquid compresses the second volume of gas to a second pressure greater than the first pressure, wherein pressurized liquid is simultaneously provided to the first and second chambers, and wherein the first and second Coanda nozzles for the first and second chambers are configured to increase entrainment of gas in the pressurized liquid during compression.

2. The method of claim 1, further comprising:

providing a first pump configured to supply pressurized liquid to the first chamber; and providing a second pump configured to supply pressurized liquid to the second chamber, wherein the first and second pumps are arranged in series.

3. The method of claim 2, further comprising driving the first and second pumps with a same motor.

4. The method of claim 1, further comprising operating a control valve that is arranged between the first and second chambers, wherein the control valve is configured to control flow of at least one of pressurized liquid and gas between the first and second chambers.

5. The method of claim 4, wherein the second chamber is positioned at a higher height with respect to the first chamber, and wherein the pressurized liquid flows by the force of gravity between the second and first chambers when the control valve is in an open position.

6. The method of claim 1, further comprising providing pressurized liquid to the first and second chambers from a liquid tank fluidly connected to the first and second chambers, wherein the liquid tank stores the liquid therein.

7. The method of claim 1, further comprising separating the pressurized liquid from the gas while maintaining the gas at approximately the second pressure in a separator assembly fluidly connected to the second chamber.

8. The method of claim 1, wherein compressing gas in at least one of the first and second chambers further comprises cooling the gas within the first or second chamber with the liquid at a high rate of heat transfer as it is compressed in order to approach isothermal compression.

9. The method of claim 1, wherein the pressurized liquid is at least one of water, gasoline, diesel and a mixture of water and monoethylene glycol.

10. The method of claim 1, wherein providing pressurized liquid to at least one of the first and second chambers through the first or second Coanda nozzle further comprises:

forming at least one liquid jet, said liquid jet having a first pressure and a first turbulence;

receiving the liquid jet on a curved surface; and guiding the liquid jet along the curved surface to create an area in the liquid jet having pressure lower than the first pressure and having turbulence greater than the first turbulence in the liquid jet.

11. A system for compressing a gas using a liquid, comprising:

a first chamber configured for compressing gas to a first pressure, the low pressure chamber comprising a first Coanda nozzle;

a second chamber configured for compressing gas to a second pressure greater than the first pressure, the second chamber being fluidly connected to the first chamber and comprising a second Coanda nozzle; and a pump assembly comprising:

a first pump in fluid connection with the first chamber and configured to supply liquid to the first chamber through the first Coanda nozzle to compress gas to the first pressure; and a second pump in fluid connection with the second chamber and configured to supply liquid to the second chamber through the second Coanda nozzle to compress gas to the second pressure, wherein the second pump is arranged in series with the first pump, and wherein the first and second Coanda nozzles for the first and second chambers are configured to increase entrainment of gas in the liquid during compression.

12. The system of claim 11, wherein the first and second pumps are configured to supply liquid to the first and second chambers to simultaneously compress gas to the first and second pressures, respectively.

13. The system of claim 11, wherein the pump assembly comprises a motor configured to drive the first and second pumps.

14. The system of claim 11, further comprising a control valve arranged between the first and second chambers, wherein the control valve is configured to control flow of at least one of liquid and gas between the first and second chambers.

15. The system of claim 14, wherein the second chamber is positioned at a higher height with respect to the first chamber, and wherein the liquid flows by the force of gravity between the first and second chambers when the control valve is in an open position.

16. The system of claim 11, further comprising a liquid tank fluidly connected to the first and second chambers and the pump assembly, wherein the liquid tank stores the liquid therein.

17. The system of claim 11, further comprising a separator assembly fluidly connected to the second chamber, wherein the separator assembly is configured to separate the liquid from the gas while maintaining the gas at approximately the second pressure.

18. The system of claim 11, wherein the first chamber and the first Coanda nozzle and the second chamber and the second Coanda nozzle are configured to enhance the circulation of the gas while the gas is being compressed within at least one of the first or second chamber such that the gas is cooled as it is compressed in the at least one of the first and second chambers with the liquid in the at least one of the first or second chambers at a high rate of heat transfer as it is compressed in order to approach isothermal compression.

19. The system of claim 11, wherein the liquid is at least one of water, gasoline, diesel and a mixture of water and monoethylene glycol.

20. The system of claim 11, wherein each of the Coanda nozzles comprises:

a jet plate having at least one slot for forming a liquid jet, said liquid jet having a first pressure and a first turbulence; and a curved entry portion in fluid connection with the jet plate, the curved entry portion receiving the liquid jet, wherein the curved entry portion is configured to create an area in the liquid jet having pressure lower than the first pressure and having turbulence greater than the first turbulence in the liquid jet as the liquid jet flows along the curved entry portion.

* * * * *